US010472124B2

(12) United States Patent
Barton et al.

(10) Patent No.: US 10,472,124 B2
(45) Date of Patent: Nov. 12, 2019

(54) DOUBLE FRONT RETAIL READY PACKAGE

(71) Applicant: INTERNATIONAL PAPER COMPANY, Memphis, TN (US)

(72) Inventors: Jeremy Barton, St. Louis, MO (US); Kevin Navo, House Springs, MO (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 0 days.

(21) Appl. No.: 15/654,803

(22) Filed: Jul. 20, 2017

(65) Prior Publication Data

US 2019/0023449 A1 Jan. 24, 2019

(51) Int. Cl.

| | |
|---|---|
| ***B65D 5/52*** | (2006.01) |
| ***B65D 5/54*** | (2006.01) |
| ***B65D 5/355*** | (2006.01) |
| ***B65D 77/22*** | (2006.01) |
| ***B65D 5/02*** | (2006.01) |

(52) U.S. Cl.

CPC ..... *B65D 5/5445* (2013.01); *B65D 5/0005* (2013.01); *B65D 5/0227* (2013.01); *B65D 5/0281* (2013.01); *B65D 5/52* (2013.01); *B65D 5/5415* (2013.01); *B65D 77/22* (2013.01)

(58) Field of Classification Search

CPC ..... B65D 5/52; B65D 5/0005; B65D 5/5415; B65D 77/22

USPC ..... 206/774

See application file for complete search history.

(56) References Cited

U.S. PATENT DOCUMENTS

| | | | | |
|---|---|---|---|---|
| 6,189,780 | B1 * | 2/2001 | Kanter | B65D 5/542 229/164 |
| 2011/0284621 | A1 * | 11/2011 | Couture | B65D 5/5445 229/103 |
| 2013/0199965 | A1 * | 8/2013 | Tibbels | B65D 5/52 206/774 |

* cited by examiner

*Primary Examiner* — Andrew D Perreault

(74) *Attorney, Agent, or Firm* — Thomas W. Ryan; Michael D. Folkerts

(57) ABSTRACT

A shipping container convertible to a display configuration, formed from a one-piece blank of sheet material. The container comprises opposing first and second side walls and opposing front and back walls. Top and bottom flaps are foldably joined to respective upper and lower edges of the front, back, and side walls of the container. The front wall comprises outer and inner front panels foldably joined to respective ones of the first and second side walls. A clean cut front separation line extends across the front wall. A side separation line extends diagonally along each of the side walls from opposing ends of the front separation line to an upper back corner of each of the side walls, and a portion of the front wall and side walls above the respective front and side separation lines define a removable cover portion of the shipping container.

15 Claims, 5 Drawing Sheets

DOUBLE FRONT RETAIL READY PACKAGE

FIELD OF THE INVENTION

This invention relates generally to containers for shipping products to points of sale. More particularly, the invention is a shipping container that is convertible to a display container at the point of sale.

BACKGROUND OF THE INVENTION

It is common practice to load a quantity of individual packages of consumer products into corrugated paperboard shipping containers for bulk shipment of the packages to a point of sale. At the point of sale, the individual packages may be removed from the shipping container and placed on a shelf for display and sale to the consumer.

In some instances, the product packages may be left in the shipping container which then also serves to support and display the packages for sale. If the shipping container is a conventional box, then the retailer must cut away a portion of the box in order to expose the product packages and provide access to them by the consumers. In order to provide a more attractive display and facilitate ease of use by the retailer, combination of shipping and display containers have been developed which have one or more sections that may be removed along weakened lines to expose the product packages and provide access to them.

SUMMARY OF THE INVENTION

In accordance with an aspect of the invention, a shipping container is provided that is convertible to a display configuration and is formed from a one-piece blank of sheet material. The container comprises opposing first and second side walls and opposing front and back walls. Top flaps are foldably joined to upper edges of the first and second side walls and to upper edges of the front and back walls, and bottom flaps are foldably joined to lower edges of the first and second side walls and to lower edges of the front and back walls. The front wall comprises outer and inner front panels foldably joined to respective ones of the first and second side walls. A front separation line extends across the front wall. A side separation line extends diagonally along each of the side walls from opposing ends of the front separation line to an upper back corner of each of the side walls, and a portion of the front wall and side walls above the respective front and side separation lines define a removable cover portion of the shipping container.

The front separation line may comprise a front clean cut slit extending from the first side wall to the second side wall.

The front clean cut slit may be defined by a first clean cut slit extending across the outer front panel, and a second clean cut slit extending across the inner front panel and vertically aligned with the first clean cut slit.

The side separation lines may each comprise side clean cut slits extending from the front separation line along at least a portion of the respective first and second side walls.

The side separation lines may each comprise a perforated line extending from respective side clean cut slits toward the upper back corners of respective side walls.

Each of the outer and inner front panels may define a width substantially equal to a width of the front wall.

A joint may be provided adhering the outer front panel to the inner front panel.

The joint adhering the outer front panel to the inner front panel may comprise a glue joint.

Finger access openings may be defined on the front wall and the side walls contiguous to the respective separation lines.

In accordance with another aspect of the invention, a shipping container is provided that is convertible to a display configuration and is formed from a one-piece blank of sheet material. The container comprises opposing first and second side walls and opposing front and back walls. Top flaps are foldably joined to upper edges of the first and second side walls and to upper edges of the front and back walls, and bottom flaps are foldably joined to lower edges of the first and second side walls and to lower edges of the front and back walls. The front wall comprises an inner front panel extending from a fourth fold line to the first side wall, and an outer front panel extending from a first fold line to the second side wall and adhered to the inner front panel. A first clean cut slit extends across the outer front panel, and a second clean cut slit extends across the inner front panel and is vertically aligned with the first clean cut slit to define a front separation line extending across the front wall.

A side separation line may extend diagonally along each of the side walls from opposing ends of the front separation line toward the back wall, and a portion of the front wall and side walls above the respective front and side separation lines may define a removable cover portion of the shipping container.

The side separation lines may each comprise a side clean cut slit extending from the front separation line and a perforated line extending from the side clean cut slit toward the back wall.

The side separation lines may extend to an upper back corner of each of the side walls, and a perforation line may extend between the upper back corners of the side walls joining one of the top flaps to the back wall.

In accordance with a further aspect of the invention, a blank is provided for making a shipping container convertible to a display configuration. The blank comprises a first front panel, a first side panel, a back panel, a second side panel, and a second front panel connected in series at respective first, second, third, and fourth fold lines. Top flaps are foldably joined to upper edges of the panels, and bottom flaps are foldably joined to lower edges of the panels. A longitudinal width dimension of the first front panel is substantially equal to a longitudinal width dimension of the second front panel. A first front separation line extends longitudinally across the first front panel from the first fold line to a location adjacent to a first longitudinal end of the blank, and a second front separation line extends longitudinally across the second front panel from the fourth fold line to a location adjacent to a second longitudinal end of the blank.

The first and second front separation lines may comprise respective first and second clean cut slits.

An uncut bridging section may extend from each of the first and second clean cut slits to the first and second longitudinal ends, respectively, of the blank.

First and second side separation lines may extend diagonally from the first and second front separation lines toward upper back corners of the first and second side walls.

A section of each of the first and second side separation lines may comprise a clean cut slit extending adjacent to the respective first and second front separation lines.

A top flap may be joined to an upper edge of the back panel along a perforated line.

Cut-outs may be formed contiguous to the respective first and second front separation lines and midway their length, defining finger access openings to enable a user's fingers to be inserted therein.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

The present description is directed to a container construction comprising a half slotted container (HSC) construction that provides a display case formed as a rectangular tube comprising a cover portion that is removably attached to a base portion along separation lines to form a display window on the base portion in a display configuration of the container. The described container can be formed from a one-piece blank processed either with equipment designed for this purpose or by hand. For example, the blank may be processed through flexo-folder-gluer machinery to produce a glued, folded container that can be opened using currently available case erector machinery or can be produced through manually executed steps, or through a combination of machine implemented and manual steps. The erected container can enclose a product for shipping the product to a point of sale, where the removable section may be separated from the display base to display the product.

Figure 1:
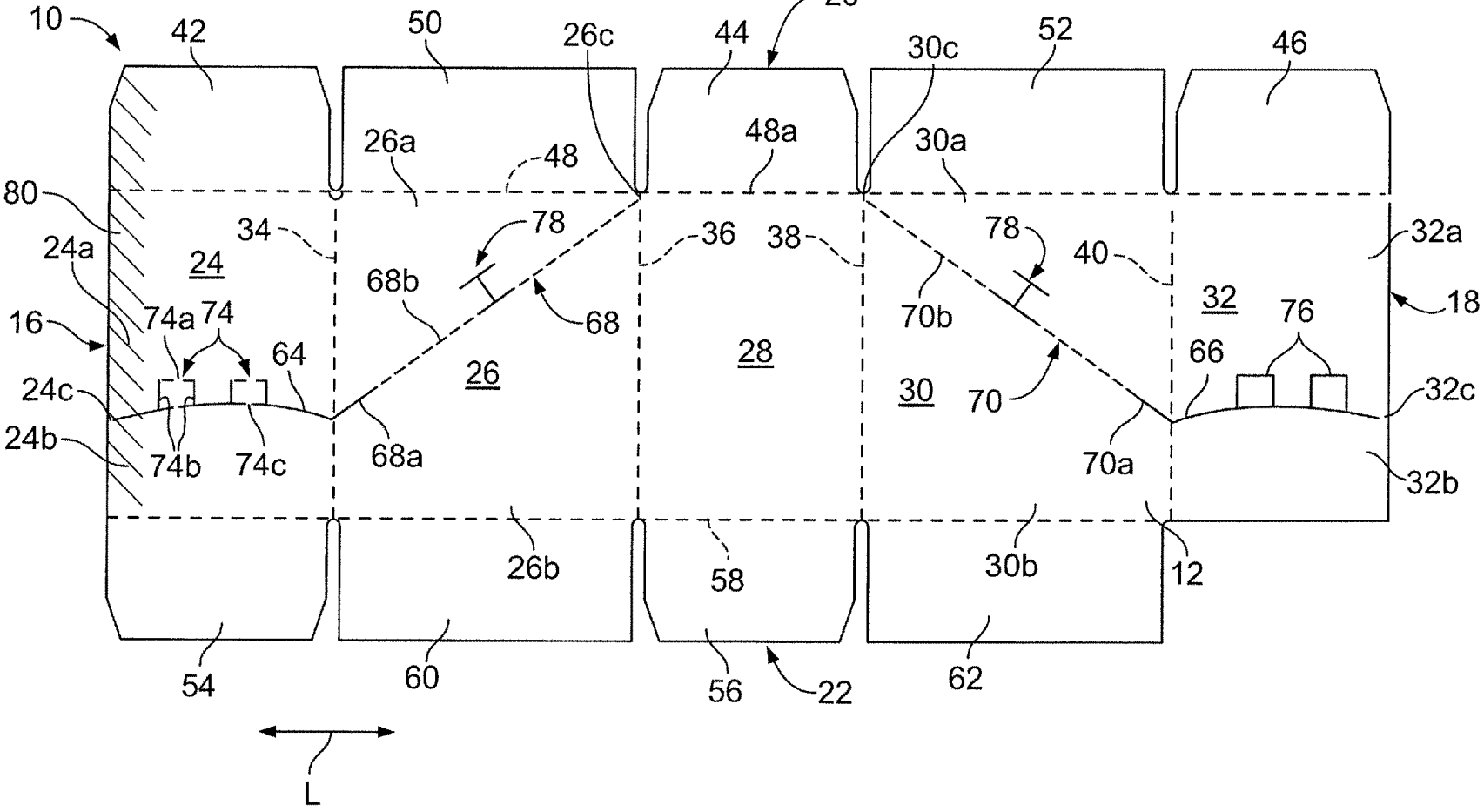
FIG. 1 is a plan view of a blank for forming a container.
Figure 2:
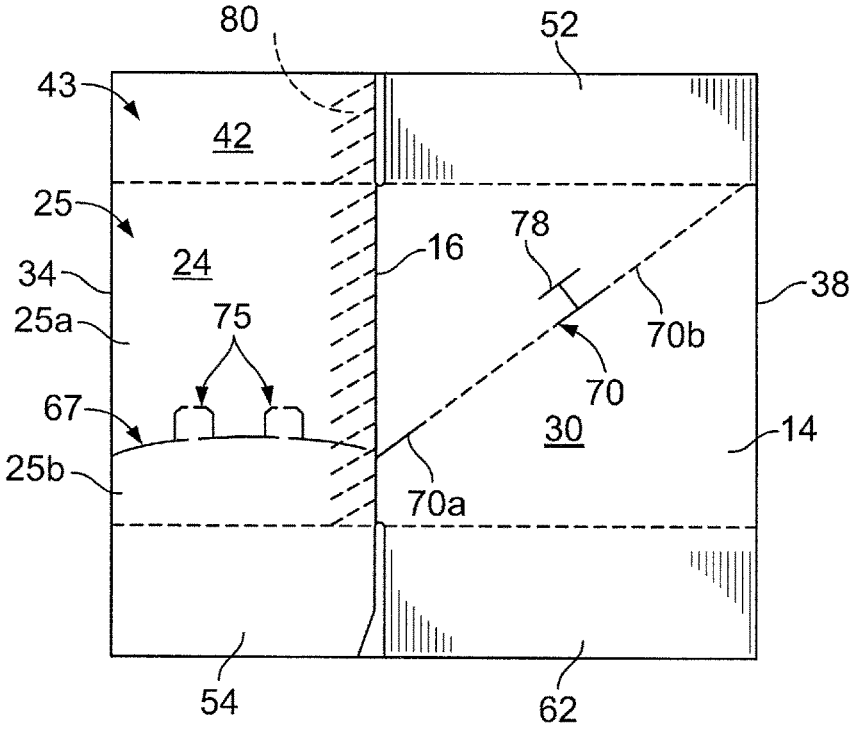
FIG. 2 is a plan view of a folded and glued blank forming a collapsed container.

Referring to FIG. 1, a die cut blank 10 is shown for illustrating one or more aspects of the container described herein. In a use of the blank 10 to form a one-piece container 8, see FIG. 5, the blank 10 may be formed of a corrugated cardboard material and may be die cut to the shape shown herein, although other materials and variations of the illustrated shape may be provided within the scope of the container described and claimed herein. The blank 10 illustrated in FIG. 1 is a planar piece of material in which an inner side 12 is shown facing out of the page and an outer side 14, see FIG. 2, is facing an opposite direction from the inner side 12.

As seen in FIG. 1, the blank 10 extends in a longitudinal direction L between first and second longitudinal ends, generally designated 16 and 18, respectively, and further extends in a lateral direction, perpendicular to the longitudinal direction L, between first and second lateral edges, generally designated 20 and 22, respectively. The blank 10 comprises a first front panel 24, a first side panel 26, a back panel 28, a second side panel 30, and a second front panel 32 connected in series. The first front panel 24 is connected to the first side panel 26 at a first vertical fold line 34, the first side panel 26 is connected to the back panel 28 at a second vertical fold line 36, the back panel 28 is connected to the second side panel 30 at a third vertical fold line 38, and the second side panel 30 is connected to the second front panel 32 at a fourth vertical fold line 40. A longitudinal width dimension of the first front panel 24, extending in the longitudinal direction L, may be substantially equal to a longitudinal width dimension of the second front panel 32, wherein the width dimension of the second front panel 32 may be slightly less than the width dimension of the first front panel 24, e.g., approximately one-half inch shorter than the first front panel 24, to facilitate overlapping relation of the first and second front panels 24, 32 in the assembled container, as is further described below.

Minor top flaps 42, 44, 46 are joined to upper edges of the first front panel 24, the back panel 28, and the second front panel 32, respectively, along an upper longitudinal fold line 48. Major top flaps 50, 52 are joined to upper edges of the respective first and second side panels 26, 30 along the upper longitudinal fold line 48. Minor bottom flaps 54, 56 are joined to bottom edges of the first front panel 24 and the back panel 28, respectively, along a lower longitudinal fold line 58. Major bottom flaps 60, 62 are joined to the respective first and second side panels 26, 30 along the lower longitudinal fold line 58.

A first front separation line 64 extends longitudinally across the width of the first front panel 24 from the first fold line 34 to a location adjacent to the first longitudinal end 16 of the blank 10, and a second front separation line 66 extends longitudinally across the width of the second front panel 32 from the fourth fold line 40 to a location adjacent to the second longitudinal end 18 of the blank 10. The first front separation line 64 divides the first front panel 24 into an upper portion 24*a* and a lower portion 24*b*, and the second front separation line 66 divides the second front panel 32 into an upper portion 32*a* and a lower portion 32*b*. The second front separation line 66 is vertically aligned with the first front separation line 64. That is, the second front separation line 66 is aligned with the first front separation line 64 in the lateral direction perpendicular to the longitudinal direction L, see FIG. 1.

The first and second front separation lines 64, 66 preferably comprise first and second clean cut slits, such that a smooth upper edge is defined along the upper edges of the lower portions 24*b*, 32*b* in the display configuration of the container. As used herein, "clean cut slit" refers to a continuous through-cut extending between the inner and outer surfaces 12, 14 of the blank 10 and defining a smooth cut edge. The upper and lower portions 24*a*, 24*b* of the first front panel 24 are connected to each other by a narrow uncut bridging section of material 24*c* extending from the separation line 64 to the first longitudinal end 16, and the upper and lower portions 32*a*, 32*b* of the second front panel 32 are connected to each other by a narrow uncut bridging section of material 32*c* extending from the separation line 66 to the second longitudinal end 18.

A first side separation line 68 extends diagonally across the first side panel 26 from the first front separation line 64 to an upper back corner 26*c* of the first side panel 26. The first side separation line 68 divides the first side panel 26 into an upper panel portion 26*a* and a lower panel portion 26*b*. Similarly, a second side separation line 70 extends diagonally across the second side panel 30 from the second front separation line 66 to an upper back corner 30*c* of the second side panel 30. The second side separation line 70 divides the second side panel 30 into an upper panel portion 30*a* and a lower panel portion 30*b*.

Respective sections 68*a* and 70*a* of the first and second side separation lines 68, 70, located adjacent to the first and second front separation lines 64 and 66, are defined by clean cut slits, i.e., forming side clean cut slits, and a remaining section 68*b*, 70*b* of the separation lines 68, 70 comprises a perforated line extending from the respective clean cut lines 68*a*, 70*a* toward the upper back corners 26*c*, 30*c*. As used herein, "perforated line" refers to a cut line that extends completely or partially through the material and which is interrupted by a series of short sections of bridging (uncut) material. A portion of the upper fold line 48 forming the connection between the minor top flap 44 and the back panel 28 comprises perforated line 48*a* that extends between the upper back corners 26*c*, 30*c*. Hence, a substantially continuous separation line is defined by the front separation lines 64, 66, the side separation lines 68, 70, and the perforated line 48*a*.

One or more first finger access openings 74 may be provided in the upper portion 24*a* of the first front panel 24, contiguous to the first front separation line 64. In the illustrated embodiment, two finger access openings 74 are shown positioned on either side of a midway point of the first front separation line 64. The finger access openings 74 may be formed as flaps comprising an upper horizontal fold 74*a* on either side of vertical clean slits 74*b*. A narrow bridge section 74*c* may be provided connecting the flaps of the finger access openings 74 to the lower portion 24*b* to maintain the flaps in a closed position coplanar with the blank 10. Similarly, one or more second finger access openings 76 may be provided in the upper portion 32*a* of the second front panel 32, contiguous to the second front separation line 66. In the illustrated embodiment, two second finger access openings 76 may be provided positioned as described for the first finger access openings 74. The second finger access openings 76 may be provided as cut-outs generally matching the shape of the first finger access openings 74.

The first and second side panels 26, 30 may each include a side finger access opening 78 located midway along the length of the separation lines 68, 70. The side finger access openings 78 may be formed as I-shaped clean cut slits that are contiguous with the separation lines 68, 70.

In forming the blank into a container, an adhesive strip 80, e.g., glue, may be applied to the inner side 12 of the blank 10 adjacent to the first longitudinal edge 16, see FIG. 1. As illustrated in FIG. 2, the blank 10 is folded about the third vertical fold line 38 to pivot the second side panel 30 and second front panel 32 to a position overlapping the first side panel 26 and the back panel 28, locating the second longitudinal end 18 adjacent to the first vertical fold line 34, see FIG. 3, and the first front panel 24 is folded about the first vertical fold line 34 to position the first front panel overlapping the second front panel 32 and positioning the adhesive strip 80 to form a joint adhesively attaching the first and second front panels 24, 32 together. In the folded and glued position, the first front panel 24 comprises an outer front panel and the second front panel 32 comprises an inner front panel. It may be noted that both the first front panel 24 and its associated minor top flap 42 are adhesively attached to the second front panel 32 and its associated minor top flap 46, respectively, to define a collapsed container. In the overlapped position of the first and second front panels 24, 32, the first and second front separation lines 64, 66 align with each other vertically and horizontally in overlapping relation to define a front wall separation line 67, and the first and second finger access openings 74, 76 align with each other vertically and horizontally in overlapping relation to define front wall access openings 75. The collapsed container is configured as a collapsed rectangular tube that can be shipped to a customer where it is erected and filled with a product for shipping.

Figure 3:
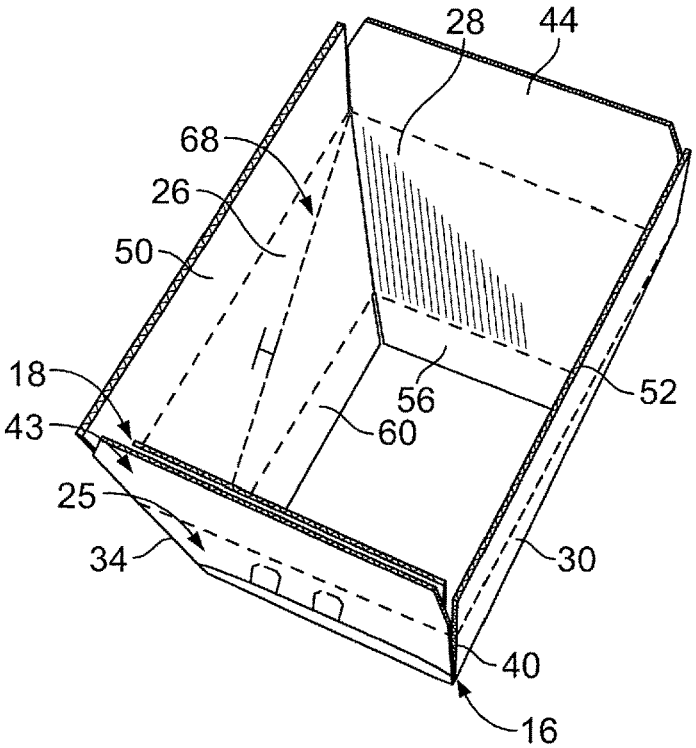
FIG. 3 is a perspective view of the container opened into a rectangular tubular configuration.
Figure 4:
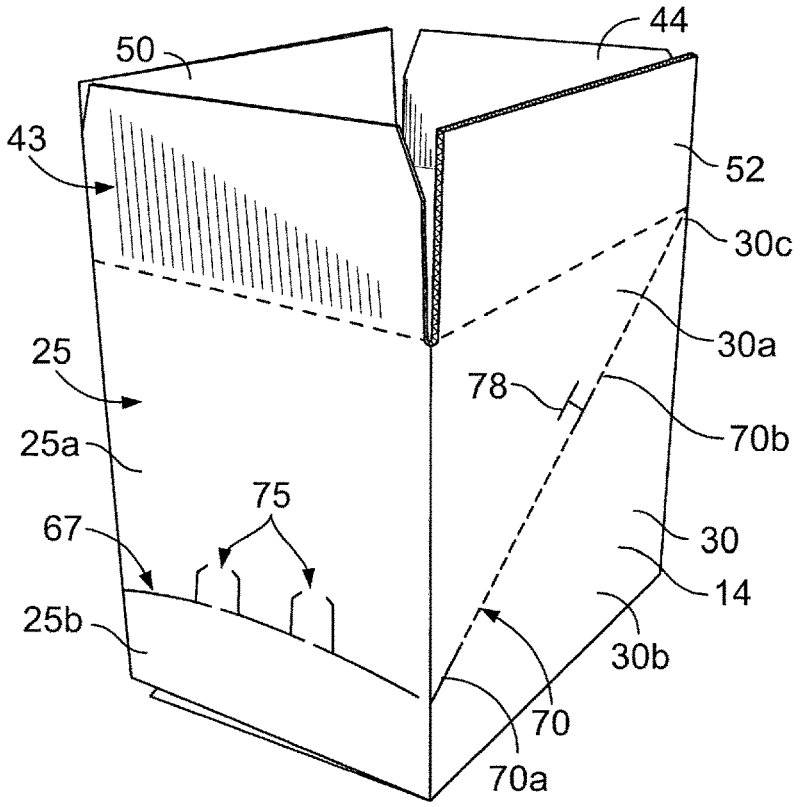
FIG. 4 is a perspective view of the container with the bottom flaps folded.
Figure 5:
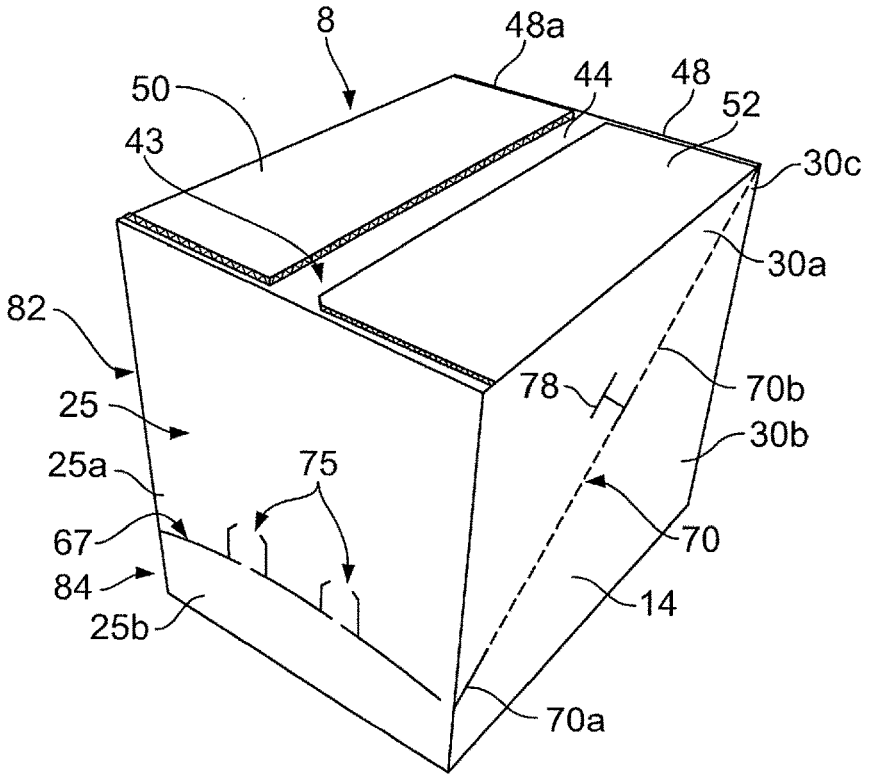
FIG. 5 is a perspective view of the container with top flaps closed to define a configuration for shipping a product.

The steps for erecting the container are illustrated in FIGS. 3-5. In FIG. 3, the container is shown opened up into a rectangular tube and oriented with the top flaps up and the bottom flaps down. The rectangular tube comprises a back wall defined by the back panel 28, opposing first and second side walls defined by the respective first and second side panels 26, 30, and a front wall opposing the back wall and defined by the first and second front panels 24, 32, and designated front wall 25, including upper and lower front wall portions 25*a*, 25*b*, see also FIG. 4. It may be noted that, a front top flap is formed by the top flaps 42, 46 associated with the respective first and second front panels 24, 32, and designated minor top flap 43. Hence, the top flaps for the container comprise the minor top flap 43 associated with the front wall 25, the minor top flap 44 associated with the back panel 28, and the major top flaps 50, 52 associated with the first and second side panels 26, 30.

As may be understood from the above description of the front wall 25, in the erected configuration of the container, the front wall 25 comprises the second front panel 32 extending from the fourth fold line 40 to the first side panel 26, and the first front panel 24 extending from the first fold line 34 to the second side wall 30 and adhered to the second front panel 32.

Figure 6:
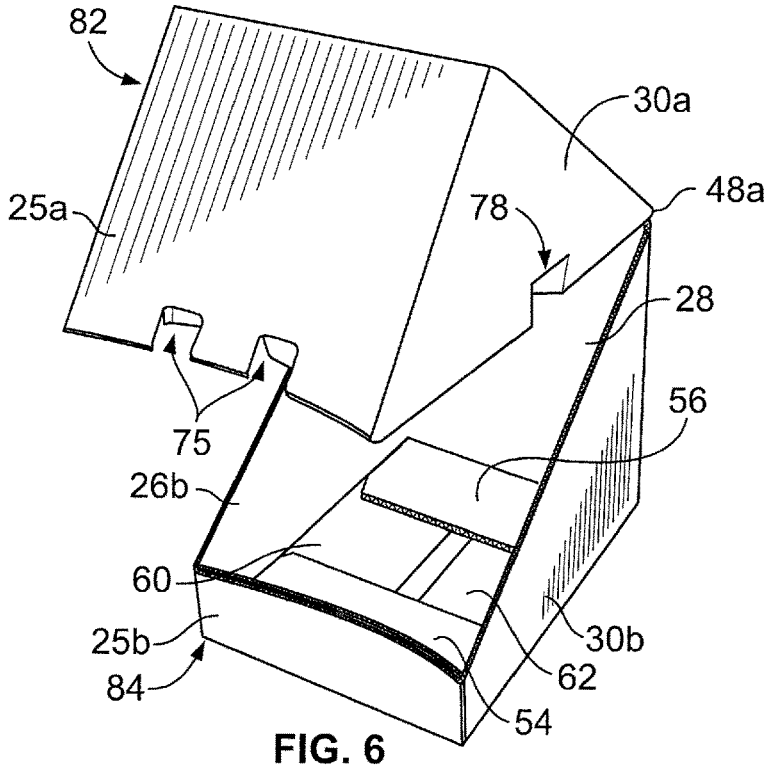
FIG. 6 is a perspective view of the container in the process of being opened.

Referring to FIGS. 4 and 6, the bottom flaps can initially be folded in, including folding the two minor bottom flaps 54, 56 in toward each other, and folding the two major bottom flaps 60, 62 in toward each other overlapping the minor bottom flaps 54, 56. The bottom flaps may be secured in their folded positions in any suitable way, such as by use of adhesive, tape, or other fastener. The container may then be filled with a product, such as cans (not shown), and the top flaps can be folded, including folding the two minor top flaps 43, 44 in toward each other, and folding the two major top flaps 50, 52 in toward each other overlapping the minor top flaps 43, 44 to form a shipping container 8, see FIG. 5. The top flaps may be secured in their folded positions in any suitable way, such as by use of adhesive, tape, or other fastener.

Figure 7:
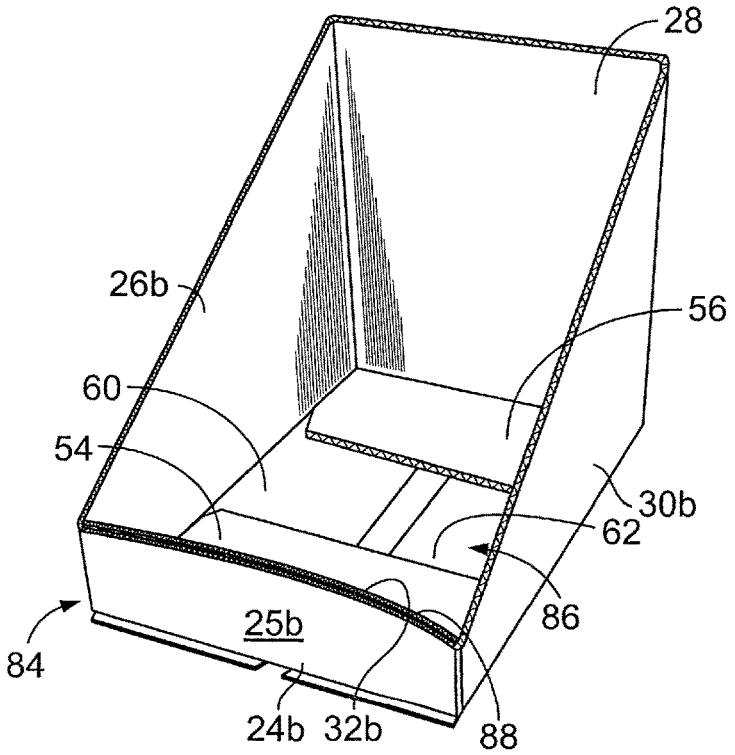
FIG. 7 is a perspective view of a base portion of the container following removal of a cover portion to form a display configuration.

As seen in FIG. 5, the shipping container 8 includes a removable cover portion 82 defined by the upper portion 25*a* of the front wall 25, the upper panel portions 26*a*, 30*a* of the first and second side panels 26, 30, and the top flaps 43, 44, 50, 52, wherein the upper portion 25*a* of the front wall 25 is defined by the upper portions 24*a*, 32*a* of the respective first and second front panels 24, 32. The shipping container 8 further includes a display base 84 defined by the lower portion 25*b* of the front wall 25, the lower panel portions 26*b*, 30*b* of the first and second side panels 26, 30, the back panel 28 and the bottom flaps 54, 56, 60, 62, wherein the lower portion 25*b* of the front wall 25 is defined by the lower portions 24*b*, 32*b* of the respective first and second front panels 24, 32, see also FIGS. 6 and 7.

The container 8 can be converted to a display case comprising the base portion 84 and enclosed product (not shown) by removing the cover portion 82. For example, at the point of sale, cover portion 82 can be grasped through the front wall finger access openings 75 and through the side finger access openings 78 to release the cover portion 82 from the base portion 84 along the separation lines 67, 68, 70, see FIGS. 5 and 6. The cover portion 82 can then be pivoted up about the upper fold line 48. Subsequently, the cover portion 82 can be separated from the base portion 84 along the perforation line 48*a* to provide a display window 86, and the base portion 84 with product (not shown) may be used as a display at the point of sale, see FIG. 7.

In accordance with an aspect of the container 8, the display window 86 defined by the base portion 84 includes a front upper edge 88 formed at upper edges of the lower front panel portions 24*b*, 32*b*. The front upper edge 88 may be configured with a downward facing curve or arc shape extending across the width of the base portion 84. By forming the front wall separation line 67, as defined by the separation lines 64, 66 in the front panels 24, 32, as a clean cut slit, the front upper edge 88 is formed as a smooth edge surface and does not include the surface irregularities that could result from a perforated separation line. Further, the double thickness provided by the lower front panel portions 24*b*, 32*b* form a stiff front wall 25 for the base portion 84 that resists bending or other distortion when used in the display configuration. Hence, the front upper edge 88 of the display window 86 is provided with an attractive appearance and has a stiff structural characteristic when the base portion 84 is used as a display case for sale of products.

It should be understood that although the front upper edge 88 is illustrated with an arc shape, other shapes or configurations for the front upper edge 88 may be provided. Further, it should be understood that, although the present description refers to use of the container 8 at a point of sale, use of the container 8 is not limited to this particular application and may be implemented for other shipping operations.

Figure 8:
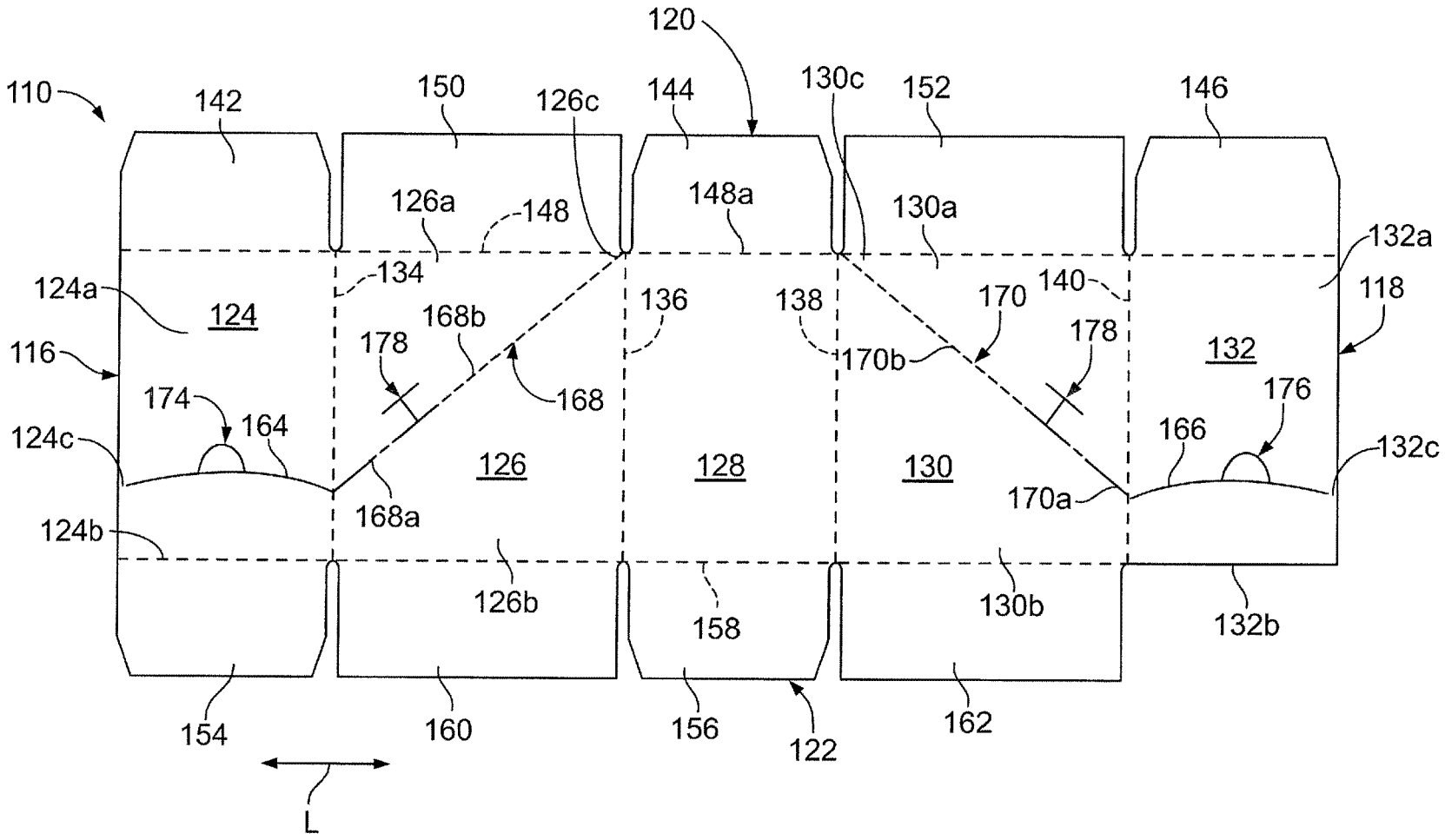
FIG. 8 is a plan view of an alternative blank for forming a container.

Referring to FIG. 8, an alternative configuration of a die cut blank 110 is shown for illustrating one or more aspects of the container described herein, and could be used for shipping and displaying a smaller quantity of product, such as cans (not shown), than the container 8 described above.

As seen in FIG. 8, the blank 110 extends in a longitudinal direction L between first and second longitudinal ends, generally designated 116 and 118, respectively, and further extends in a lateral direction between first and second lateral edges, generally designated 120 and 122, respectively. The blank 110 comprises a first front panel 124, a first side panel 126, a back panel 128, a second side panel 130, and a second front panel 132 connected in series. The first front panel 124 is connected to the first side panel 126 at a first vertical fold line 134, the first side panel 126 is connected to the back panel 128 at a second vertical fold line 136, the back panel 128 is connected to the second side panel 130 at a third vertical fold line 138, and the second side panel 130 is connected to the second front panel 132 at a fourth vertical fold line 140. A longitudinal width dimension of the first front panel 124, extending in the longitudinal direction L, may be substantially equal to a longitudinal width dimension of the second front panel 132, wherein width dimension of the second front panel 132 may be slightly less than the width dimension of the first front panel 124, e.g., approximately one-half inch shorter than the first front panel 124, to facilitate overlapping relation of the first and second front panels 124, 132 in the assembled container.

Minor top flaps 142, 144, 146 are joined to upper edges of the first front panel 124, the back panel 128, and the second front panel 132, respectively, along an upper longitudinal fold line 148. Major top flaps 150, 152 are joined to upper edges of the respective first and second side panels 126, 130 along the upper longitudinal fold line 148. Minor bottom flaps 154, 156 are joined to bottom edges of the first front panel 124 and the back panel 128, respectively, along a lower longitudinal fold line 158. Major bottom flaps 160, 162 are joined to the respective first and second side panels 126, 130 along the lower longitudinal fold line 158.

A first front separation line 164 extends longitudinally across the width of the first front panel 124 from the first fold line 134 to a location adjacent to the first longitudinal end 116 of the blank 110, and a second front separation line 166 extends longitudinally across the width of the second front panel 132 from the fourth fold line 140 to a location adjacent to the second longitudinal end 118 of the blank 110. The first front separation line 164 divides the first front panel 124 into an upper portion 124*a* and a lower portion 124*b*, and the second front separation line 166 divides the second front panel 132 into an upper portion 132*a* and a lower portion 132*b*. The second front separation line 166 is vertically aligned with the first front separation line 164. That is, the second front separation line 166 is aligned with the first front separation line 164 in a direction perpendicular to the longitudinal direction L.

The first and second front separation lines 164, 166 preferably comprise first and second clean cut slits, such that a smooth upper edge is defined along the upper edges of the lower portions 124*b*, 132*b* in the display configuration of the container. The upper and lower portions 124*a*, 124*b* of the first front panel 124 are connected to each other by a narrow uncut bridging section of material 124*c* extending from the separation line 164 to the first longitudinal end 116, and the upper and lower portions 132*a*, 132*b* of the second front panel 132 are connected to each other by a narrow uncut bridging section of material 132*c* extending from the front separation line 166 to the second longitudinal end 118.

A first side separation line 168 extends diagonally across the first side panel 126 from the first front separation line 164 to an upper back corner 126*c* of the first side panel 126. The first side separation line 168 divides the first side panel 126 into an upper panel portion 126*a* and a lower panel portion 126*b*. Similarly, a second side separation line 170 extends diagonally across the second side panel 130 from the second front separation line 166 to an upper back corner 130*c* of the second side panel 130. The second side separation line 170 divides the second side panel 130 into an upper panel portion 130*a* and a lower panel portion 130*b*.

Respective sections 168*a* and 170*a* of the first and second side separation lines 168, 170, located adjacent to the first and second front separation lines 164 and 166, are defined by clean cut slits, i.e., forming side clean cut slits, and a remaining section 168*b*, 170*b* of the separation lines 168, 170 comprises a perforated line extending from the respective clean cut lines 168*a*, 170*a* toward the upper back corners 126*c*, 130*c*. A portion of the upper fold line 148 forming the connection between the minor top flap 144 and the back panel 128 comprises perforated line 148*a* that extends between the upper back corners 126*e*, 130*c*. Hence, a substantially continuous separation line is defined by the front separation lines 164, 166, the side separation lines 168, 170, and the perforated line 148*a*.

A first finger access opening 174 may be provided in the upper portion 124*a* of the first front panel 124, contiguous to the first front separation line 164. In the illustrated embodiment, the first finger access opening is a semi-circular cut-out slot. Similarly, second finger access opening 176 may be provided in the upper portion 132*a* of the second front panel 132, contiguous to the second front separation line 166, and may comprise a semi-circular cut-out slot. The first and second finger access openings may be positioned generally midway along the length of the respective first and second front separation lines 164, 166.

The first and second side panels 126, 130 may each include a side finger access opening 178 located intermediate the ends of the side separation lines 168, 170. The side finger access openings 178 may be formed as I-shaped clean cut slits that are contiguous with the separation lines 168, 170.

In use of the blank 110 to form a shipping container and display case, the blank 110 may folded and glued in the same manner as described for the blank 10, as shown in FIGS. 1 and 2. Further, the folded and glued blank 110 may be erected into a container and configured to a display configuration as described above for the container 8 and as illustrated further in FIGS. 3-7.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shipping container convertible to a display configuration, formed from a one-piece blank of sheet material, the container comprising:

opposing first and second side walls and opposing front and back walls;

top flaps foldably joined to upper edges of the first and second side walls and to upper edges of the front and back walls, and bottom flaps foldably joined to lower edges of the first and second side walls and to lower edges of the front and back walls;

the front wall comprising outer and inner front panels foldably joined to respective ones of the first and second side walls;

a front separation line comprising a front clean cut slit extending substantially continuously across the front wall, wherein the front clean cut slit is defined by a first clean cut slit extending substantially continuously across the outer front panel, and a second clean cut slit extending substantially continuously across the inner front panel and vertically aligned with the first clean cut slit to form a smooth cut edge extending across the front panels and wherein the front separation line divides the outer and inner front panels into upper and lower portions, and includes an uncut bridging section on at least one of the panels connecting the upper and lower portions of the at least one panel; and a side separation line extending diagonally along each of the side walls from opposing ends of the front separation line to an upper back corner of each of the side walls, a portion of the front wall and side walls above the respective front and side separation lines defining a removable cover portion of the shipping container.

2. The shipping container as set forth in claim 1, wherein the side separation lines each comprise side clean cut slits extending from the front separation line along at least a portion of the respective first and second side walls.

3. The shipping container as set forth in claim 2, wherein the side separation lines each comprise a perforated line extending from respective side clean cut slits toward the upper back corners of respective side walls.

4. The shipping container as set forth in claim 1, wherein each of the outer and inner front panels define a width substantially equal to a width of the front wall.

5. The shipping container as set forth in claim 1, including a joint adhering the outer front panel to the inner front panel.

6. The shipping container as set forth in claim 5, wherein the joint adhering the outer front panel to the inner front panel comprises a glue joint.

7. The shipping container as set forth in claim 1, wherein finger access openings are defined on the front wall and the side walls contiguous to the respective separation lines.

8. The shipping container as set forth in claim 1, wherein the upper and lower portions of the outer front panel are adhered to the upper and lower portions, respectively, of the inner front panel.

9. The shipping container as set forth in claim 1, including two or more uncut bridging sections connecting the upper and lower portions of the at least one panel with clean cut slit portions defined on the at least one panel between the uncut bridging sections, wherein a length of at least one of the clean cut slit portions is greater than a cumulative length of the uncut bridging sections.

10. A shipping container convertible to a display configuration, formed from a one-piece blank of sheet material, the container comprising:

opposing first and second side walls and opposing front and back walls;

top flaps foldably joined to upper edges of the first and second side walls and to upper edges of the front and back walls, and bottom flaps foldably joined to lower edges of the first and second side walls and to lower edges of the front and back walls;

the front wall comprises an inner front panel extending from a fourth fold line to the first side wall, and an outer front panel extending from a first fold line to the second side wall and adhered to the inner front panel; and a first clean cut slit extending substantially continuously across the outer front panel, and a second clean cut slit extending substantially continuously across the inner front panel and vertically aligned with the first clean cut slit to define a front separation line comprising a smooth clean cut edge extending across the front wall; wherein the front separation line divides the outer and inner front panels into upper and lower portions, and including an uncut bridging section on at least one of the panels connecting the upper and lower portions of the at least one panel.

11. The shipping container as set forth in claim 10, wherein a side separation line extends diagonally along each of the side walls from opposing ends of the front separation line toward the back wall, and a portion of the front wall and side walls above the respective front and side separation lines define a removable cover portion of the shipping container.

12. The shipping container as set forth in claim 11, wherein the side separation lines each comprise a side clean cut slit extending from the front separation line and a perforated line extending from the side clean cut slit toward the back wall.

13. The shipping container as set forth in claim 11, wherein the side separation lines extend to an upper back corner of each of the side walls, and a perforation line extends between the upper back corners of the side walls joining one of the top flaps to the back wall.

14. The shipping container as set forth in claim 10, wherein the first clean cut slit divides the outer front panel into upper and lower outer panel portions and a second clean cut slip divides the inner front panel into upper and lower inner panel portions, and the upper and lower outer panel portions are adhered to the upper and lower inner panel portions, respectively.

15. The shipping container as set forth in claim 10, including two or more uncut bridging sections connecting the upper and lower portions of the at least one panel with clean cut slit portions defined on the at least one panel between the uncut bridging sections, wherein a length of at least one of the clean cut slit portions is greater than a cumulative length of the uncut bridging sections.

* * * * *